US012410568B2

(12) United States Patent
Owens

(10) Patent No.: US 12,410,568 B2
(45) Date of Patent: Sep. 9, 2025

(54) SHALLOW FOUNDATION BOLLARD STRUCTURES

(71) Applicant: Delta Scientific Corporation, Palmdale, CA (US)

(72) Inventor: Matt Owens, Palmdale, CA (US)

(73) Assignee: DELTA SCIENTIFIC CORPORATION, Palmdale, CA (US)

( * ) Notice: Subject to any disclaimer, the term of this patent is extended or adjusted under 35 U.S.C. 154(b) by 805 days.

(21) Appl. No.: 17/709,120

(22) Filed: Mar. 30, 2022

(65) Prior Publication Data

US 2023/0062533 A1 Mar. 2, 2023

Related U.S. Application Data

(60) Provisional application No. 63/238,738, filed on Aug. 30, 2021.

(51) Int. Cl.
*E01F 15/00* (2006.01)

(52) U.S. Cl.
CPC ..... *E01F 15/003* (2013.01)

(58) Field of Classification Search
CPC ..... E01F 9/685; E01F 13/12; E01F 15/003
See application file for complete search history.

(56) References Cited

U.S. PATENT DOCUMENTS

| | | | | |
|---|---|---|---|---|
| 1,449,518 | A | 3/1923 | Lawson | |
| 3,934,540 | A | 1/1976 | Bruner et al. | |
| 4,490,068 | A | 12/1984 | Dickinson | |
| 5,228,237 | A | 7/1993 | Nasatka | |
| 7,104,721 | B2 | 9/2006 | Rogers et al. | |
| 7,118,304 | B2 | 10/2006 | Turpin et al. | |
| 7,699,558 | B2 | 4/2010 | Adler et al. | |
| 7,775,738 | B2 * | 8/2010 | Darcy | E01F 13/12 404/6 |
| 7,850,391 | B2 * | 12/2010 | Omar | E01F 13/12 404/6 |
| 8,215,865 | B2 | 7/2012 | Adler et al. | |
| 10,988,903 | B1 * | 4/2021 | Neusch | E01F 15/003 |

(Continued)

FOREIGN PATENT DOCUMENTS

| | | | | |
|---|---|---|---|---|
| AU | 200071449 | A1 | 5/2001 | |
| GB | 2485278 | A * | 5/2012 | E01F 13/12 |

(Continued)

OTHER PUBLICATIONS

DECISION Granting Institution of Inter Partes Review issued by the USPTO Patent Trial and Appeal Board, dated Feb. 5, 2021, 59 pages.

(Continued)

*Primary Examiner* — Gary S Hartmann
(74) *Attorney, Agent, or Firm* — Womble Bond Dickinson (US) LLP

(57) ABSTRACT

A bollard structure includes a base and a bollard. The base includes an upper wall, a lower wall, a first side wall extending between the upper and lower walls, a second side wall extending between the upper and lower walls and spaced apart from the first side wall, and a mid-wall extending between the upper and lower walls and between the first and second sidewalls. The bollard penetrates the upper wall and extends to the lower wall between the two sidewalls, such that the mid-wall extends from the bollard.

26 Claims, 4 Drawing Sheets

(56) References Cited

U.S. PATENT DOCUMENTS

| | | | | |
|---|---|---|---|---|
| 11,174,606 | B1 * | 11/2021 | Lamore | E01F 13/026 |
| 2009/0028638 | A1 * | 1/2009 | Crawford | E01F 13/12 404/6 |

FOREIGN PATENT DOCUMENTS

| | | | | |
|---|---|---|---|---|
| GB | 2600120 A * | 4/2022 | | E01F 13/048 |
| JP | 2002-115324 | 4/2002 | | |

OTHER PUBLICATIONS

DECISION Denying Institution of Inter Partes Review issued by the USPTO Patent Trial and Appeal Board, dated Nov. 21, 2019, 34 pages.

* cited by examiner

SHALLOW FOUNDATION BOLLARD STRUCTURES

CROSS-REFERENCE TO RELATED APPLICATION

This patent application claims the benefits of U.S. Provisional Patent Application Ser. No. 63/238,738, filed on Aug. 30, 2021, and entitled "SHALLOW FOUNDATION BOLLARD STRUCTURES" the entire content of which is hereby incorporated by reference in its entirety.

BACKGROUND

Vehicle barriers such as bollards are well known in the art. Shallow mounted bollards are used in situations where the bollards need to be mounted above utilities. Most shallow mounted bollards have a base which extends horizontally formed by multiple crossing tubular members. Often multiple bollards are mounted on such bases. As such the configurations and spacing between bollards is set. A shallow mounted bollard structure is desired that can be mounted independently of other bollard structures in close proximity.

SUMMARY

In an example embodiment, a bollard structure includes a base and a bollard. The base includes an upper wall, a lower wall, a first side wall extending between the upper and lower walls, a second side wall extending between the upper and lower walls and spaced apart from the first side wall, and a mid-wall extending between the upper and lower walls and between the first and second sidewalls. The bollard penetrates the upper wall and extends to the lower wall between the two sidewalls, such that the mid-wall extends from the bollard. In another example embodiment, the bollard structure further includes at least one upper reinforcing plate above the upper wall penetrated by the bollard. In a further example embodiment, the bollard structure also includes at least one lower reinforcing plate penetrated by the bollard. In one example embodiment, the mid-wall is a web of an I-beam, such that the I-beam extends from the upper wall to the lower wall. In another example embodiment, the mid-wall is a first mid-wall, and the structure further includes a second mid-wall extending from the bollard opposite from the first mid-wall. In yet another example embodiment, the second mid-wall is welded to the bollard. In a further example embodiment, the second mid-wall is a web of a second I-beam, such that the second I-beam extends from the upper wall to the lower wall. In yet a further example embodiment, the upper wall is a web of an upper channel. The upper channel includes a first wall and second wall extending transversely from the web, such that the first side wall is connected to the upper channel first wall and the second side wall is connected to the upper channel second wall. In one example embodiment, the lower wall is a web of a lower channel. The lower channel includes a first wall and second wall extending transversely from the lower channel web, such that the first side wall is connected to the lower channel first wall and the second side wall is connected to the lower channel second wall. In another example embodiment, the bollard is tubular, and the bollard structure further includes a stiffener extending within the bollard. In yet another example embodiment, the stiffener extends from a base of the bollard along at least 80% of a length of the bollard. In a further example embodiment, the stiffener is a box beam. In yet a further example embodiment, the stiffener is a plate. In one example embodiment, the stiffener is connected to opposite inner surfaces of the bollard. In another example embodiment, the first side wall includes first openings formed therethrough. In yet another example embodiment, the second side wall includes second openings formed therethrough. In a further example embodiment, the first and/or second openings are sized to receive a fork of a fork lift allowing for lifting and movement of the structure by the fork lift. In yet a further example embodiment, the first and/or second openings are sized to allow for a person to weld and inspect an interior of the bollard structure. In an example embodiment, the first and second openings are configured for receiving rebar bundles therethrough. In another example embodiment, the mid-wall includes openings axially aligned with the first and second openings for receiving rebar bundles therethrough. In yet another example embodiment, the bollard structure further includes a rebar cage surrounding the base. In a further example embodiment, the rebar cage includes a lower rebar grid and an upper rebar grid, such that the base is sandwiched between the lower and upper rebar grids. The rebar cage also includes a plurality of spaced apart truncated cone shaped rebar members extending from the upper wall to the lower rebar grid, and a plurality of hook shaped rebar members. In an example embodiment, each hook shaped rebar member of the plurality of hook shaped rebar members includes a hook portion hooked on the upper rebar grid and extending to the lower rebar grid. In yet a further example embodiment, the plurality of hook shaped rebar members are connected to the first and second rebar grids and the plurality of truncated cone shaped rebar members are connected to the lower grid.

DESCRIPTION

Figure 1:
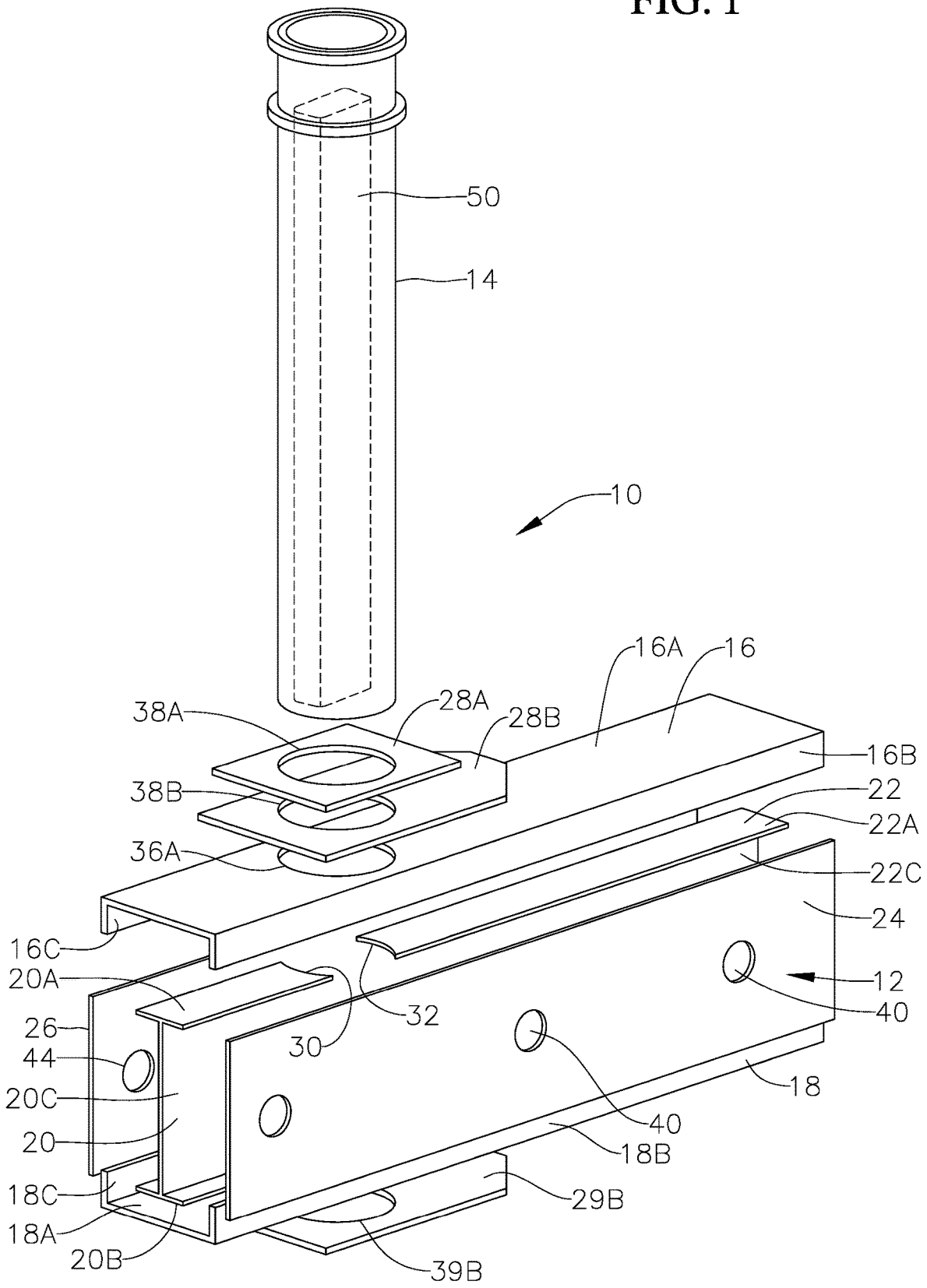
FIG. 1 is a perspective assembly view of an example embodiment bollard structure.
Figure 2:
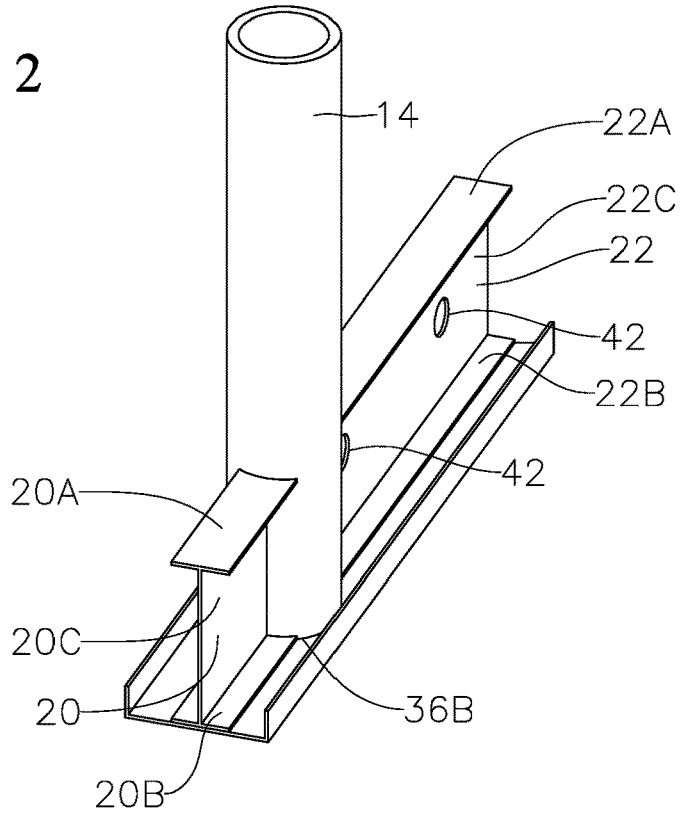
FIG. 2 is a perspective view of a partial assembled view of the bollard structure shown in FIG. 1.
Figure 3:
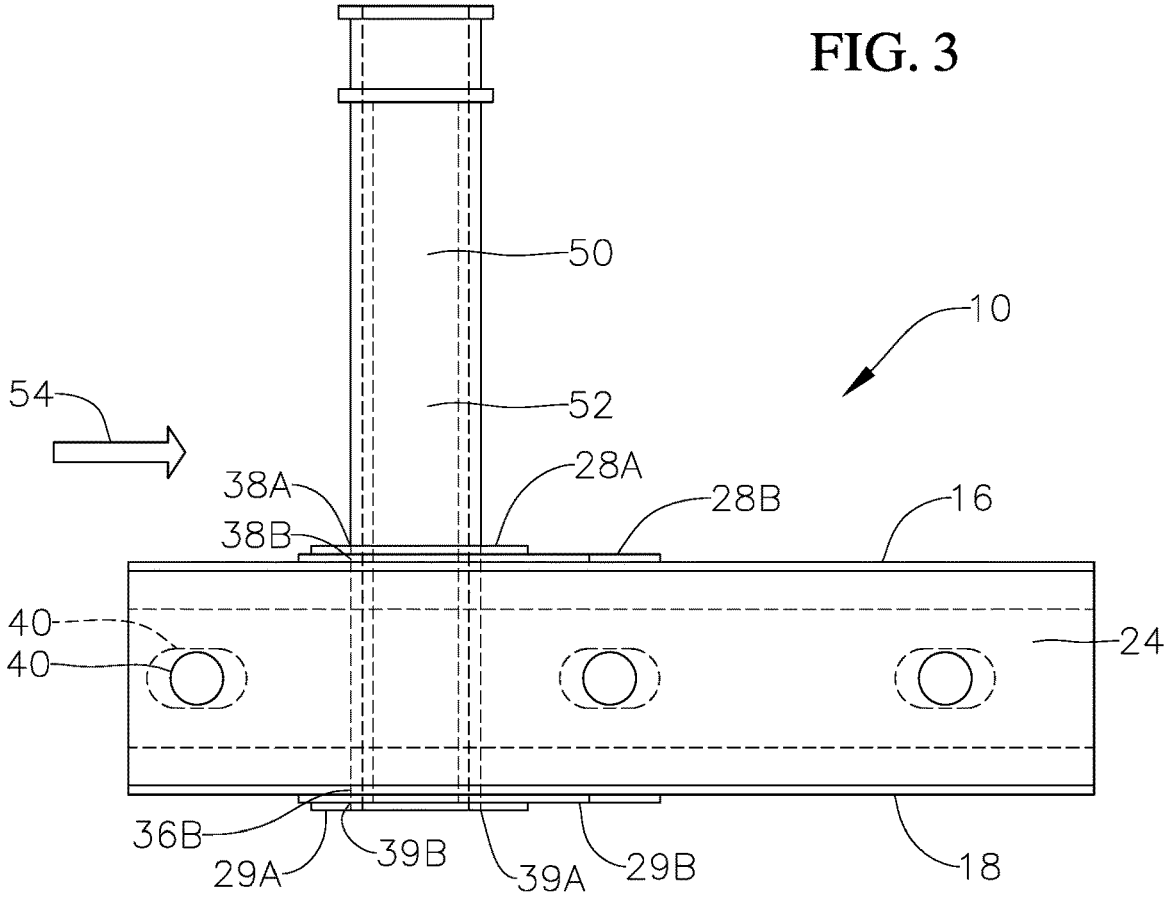
FIG. 3 is a side view of the bollard structure shown in FIG. 1.

An example shallow foundation bollard structure 10 has a base 12 from which extends a bollard 14 as for example shown in FIGS. 1, 2 and 3. In an example embodiment, the bollard is a hollow tubular bollard. The tubular bollard may have a cross-sectional shape that is circular, oval, square, rectangular, or any other geometric shape. In the shown example embodiment in FIG. 1, the tubular bollard has a circular cross-sectional shape, thus defining a circular tubular member. The base is a box beam formed by an upper channel 16, a lower channel 18, a first I-beam 20, a second I-beam 22 spaced apart from the first I-beam to receive a bollard 14 therebetween, and a first side wall 24 opposite a second side wall 26.

The first I-beam 20 has a first upper cap 20A, a lower cap 20B and a web 20C extending between the first I-beam upper and lower caps. Similarly, the second I-beam 22 has an upper cap 22A, a lower cap 22B and a web 22C extending between the second I-beam upper and lower caps. In other example embodiments, a vertical plate, or back to back channels defining an I-beam, or a box beam having an upper wall, a lower wall and two side walls extending between the upper and lower walls may be used instead of each I-beam. For illustrative purposes embodiments herein are described with using I-beams.

The upper channel 16 includes a web 16A and first and second walls 16B, 16C, extending transversely from the web defining the upper channel. The lower channel 18 includes a web 18A and first and second walls 18B, 18C, extending transversely from the lower channel web defining the lower channel. First and second upper reinforcing plates 28A and 28B, respectively, and first and second lower reinforcing plates 29*b* and 29B, respectively, may be attached above the upper channel and below the lower channel, respectively to reinforce the attachment of the bollard to the base.

The upper and lower channels define the upper and lower ends or walls of the box beam (i.e., the base). Each side wall, which in the shown example embodiment is a plate, is attached to both the upper channel and the lower channel such that the first side wall 24 forms a first side wall of the box beam while the second side wall 26 forms a second side wall of the box beam opposite the first side wall. The first and second I-beams are also welded to the upper and lower channels. In an example embodiment, an end 30 of the first I-beam facing the second I-beam, and an end 32 of the second I-beam facing the first I-beam, have curvatures complementary to the outer curvature of the bollard. Specifically, the upper and lower caps of each I-beam have a curvature complementary the outer surface curvature of the bollard. Openings 36A, 36B are formed through the upper and lower channel webs, respectively, to receive the bollard. Openings 38A, 38B are also formed through the upper reinforcing plates 28A, 28B, respectively, and openings 39*a*, 39*b* (not shown), are formed through the lower reinforcing plates 29B, 29A, respectively, to receive the bollard.

The bollard 14 penetrates the openings 38A, 38B of the upper reinforcing plates, the opening 36A of the upper channel 16, the spacing between the two I-beams, the opening 36B of the lower channel 18 and the openings 39B, 39A of the lower reinforcing plates. In an example embodiment, the bollard is welded to the upper reinforcing plates, the opening of the upper channel, both I-beams, the opening of the lower channel and the openings of the lower reinforcing plates.

Axially aligned openings 40, 42, 44 are formed through the first side wall 24, the I-beams 20, 22 and the second side wall 26, respectively, to accommodate rebar or bundles of rebar 70. In an example embodiment, the openings are also sized to receive the arms (i.e., the forks) of a fork lift, allowing for manipulation and movement of the bollard structure by a fork lift. In addition, the opening may have sufficient size to allow for welding within the base, as for example, for welding the inner surfaces of the side walls to the upper and lower channel first and second walls, and if needed welding the bollard to the I-beams as well as welding of the I-beams to the upper and lower channels. The opening 40, 42, 44 can have various shapes as for example circular as shown in FIG. 1, oval as shown in dashed is FIG. 3 and in solid in FIG. 4, or another shape that would allow for welding and/or accommodation of the arms of a fork lift.

As shown in FIG. 2, to form the bollard structure 10, the bollard 14 is placed over the lower channel 18, such that a lower end of the bollard penetrates the opening 36B of the lower channel and extends the thickness of the lower reinforcing plates 29B, 29A. The first I-beam 20 is then placed on the lower channel web inner surface along a central longitudinal axis of the lower channel such that its upper and lower curved cap ends 30 and its web 20C abut the outer surface of the bollard. Similarly, the second I-beam 22 is placed on the lower channel web inner surface along the central longitudinal axis of the lower channel such that upper and lower cap curved ends 32 and its web 22C abut the outer surface of the bollard opposite the first I-beam. In an example embodiment, the I-beams are welded to the lower channel member and to the bollard.

The upper channel 16 is placed over the bollard, such that the bollard penetrates the upper channel opening 36A. In an example embodiment, the upper channel is welded to the upper caps of the I-beams. The lower reinforcing plates 29B, 29A, are placed over the outer surface of the web 18A of the lower channel such that they are penetrated by the bollard lower end and are longitudinally aligned with the lower channel. Similarly, the upper reinforcing plates 28B, 28A, are placed over the outer surface of the web 16A of the upper channel such that they are penetrated by the bollard end and are longitudinally aligned with the upper channel. In an example embodiment, the lower reinforcing plates are welded to each other, the bollard and to the lower channel, the upper reinforcing plates are welded to each other, the bollard and the upper channel.

The first and second sidewalls 24, 26 are then welded to the vertically extending walls of the upper and lower channels. For example, the first sidewall is welded to the first walls 16B, 18B of the upper and lower channels, respectively, and the second sidewall is welded to the second walls 16C, 18C, of the upper and lower channels, respectively. The first and second sidewall may be welded in the outer surfaces of their corresponding channel vertical walls as shown in FIGS. 3 and 4 or in another example embodiment, may be welded to inner surface of their corresponding channel vertical walls.

In an example embodiment, a stiffener 50 may be inserted in the bollard that spans a majority of the bollard length and preferably at least 80% of the bollard length extending from the base of the bollard, as for example shown in FIGS. 1 and 3. In an example embodiment, the stiffener is a box beam, as for example shown in FIGS. 1 and 3. In an example embodiment, the box beam stiffener is rectangular in cross-section and is welded to opposite interior surfaces of the bollard with its longer sides 52 parallel or generally parallel to the direction of expected impact 54, as for example shown in FIG. 3. In another example embodiment, the stiffener 50 may be a plate, that extends to opposite interior surfaces of the bollard. With such embodiment, the plate is welded to opposite interior surfaces of the bollard, such that a plane of the plate is parallel or generally parallel to the direction of expected impact. In other example embodiments, the stiffener may have other geometric shapes. A box stiffener is expected provide more bending resistance to the bollard than a plate stiffener.

Figure 4:
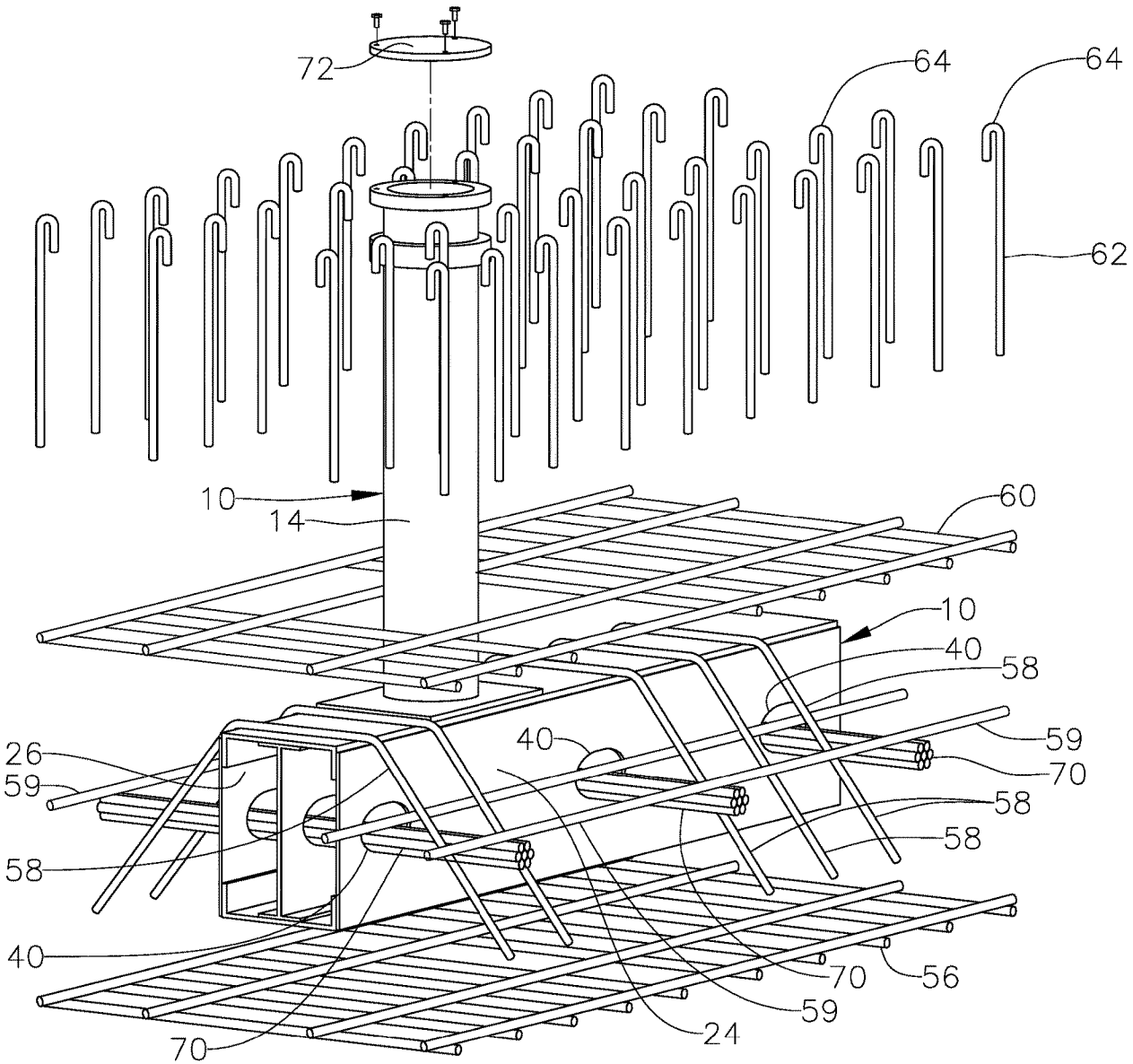
FIG. 4 is a perspective view of an example embodiment bollard structure with a rebar structure shown in assembly view.
Figure 5:
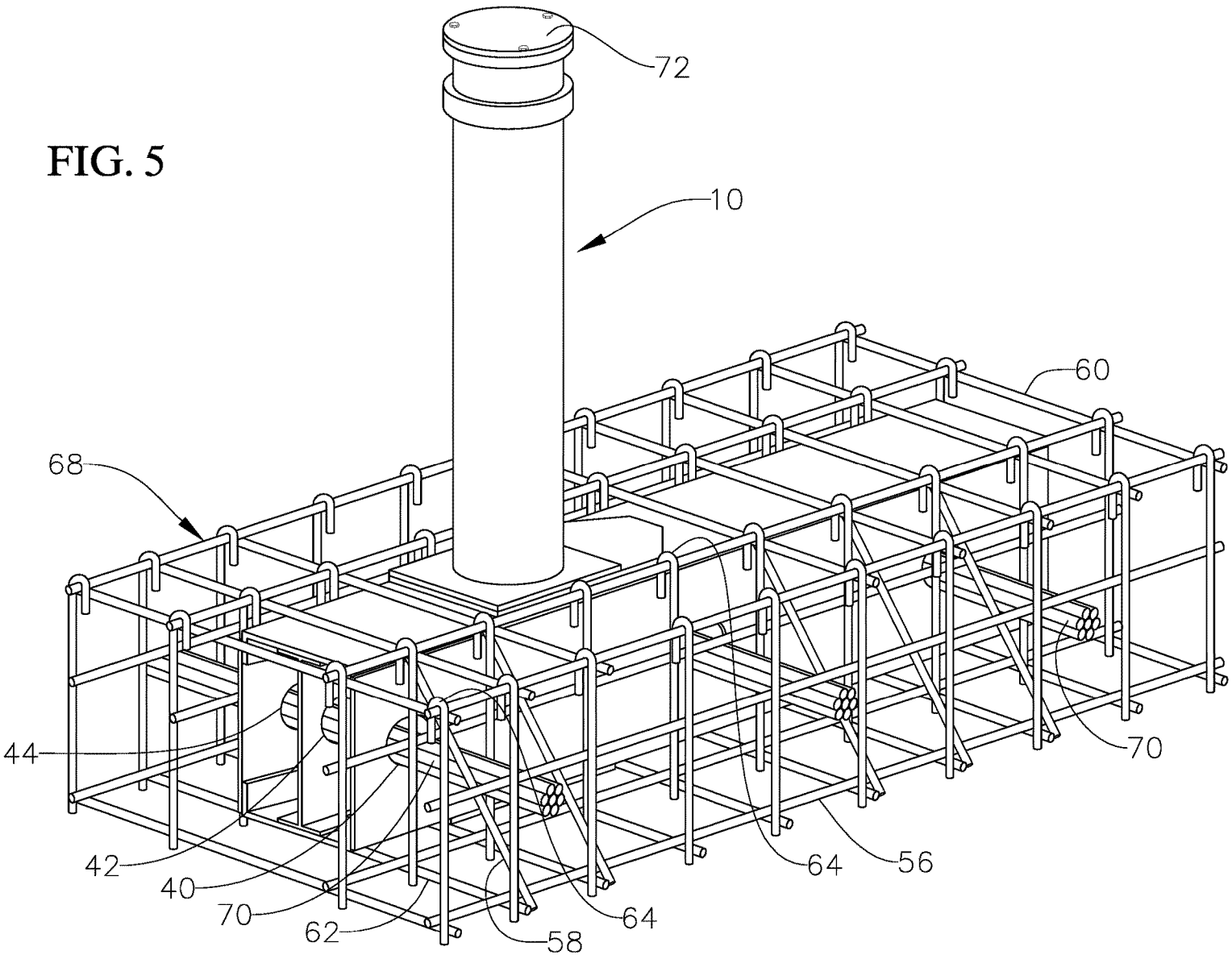
FIG. 5 is a perspective view of the example embodiment bollard structure shown in FIG. 4 with the rebar structure shown in FIG. 4.

In an example embodiment as shown in FIG. 4, during installation of the bollard structure, a first or lower rebar grid 56 is placed on the base of a shallow excavated pit. The shallow foundation bollard structure 10 is placed above the first rebar grid. In an example embodiment, truncated cone shaped rebar members 58 are placed over the base and rest on the base. Longitudinally extending rebar members 59 may be connected, as for example by welding, to the truncated cone shaped rebar members forming a truncated cone shaped rebar member grid. In an example embodiment, the truncated cone shaped rebar members are welded, tied or otherwise connected to the first rebar grid. A second or upper rebar grid 60 is placed above the bollard structure and is penetrated by the bollard 14 of the bollard structure. The second rebar grid may be connected to the truncated cone shaped rebar members. Hook shaped rebar members 62 defining a hook 64 are hung with their hooks on the second rebar grid and extend to the first rebar grid, as for example shown in FIG. 5. The hook shaped rebar members are connected to the first and second rebar grid. In an example embodiment, they may be tied or welded to the first and second rebar grids. Since the second rebar grid will be very close to the upper surface of the excavated pit after it is filled with concrete, there isn't much room for rebar overlap. Each hook shaped rebar member hook helps prevent the concrete from shearing or breaking, at or proximate such surface, in tension at the intersection of the hook and the second rebar grid. The first and second rebar grids, along with the truncated cone shaped rebar members and the hook shaped rebar members form rebar cage 68 surrounding the base 12. Rebar or rebar bundles 70 are placed and extend transversely though the base 12 of the bollard structure through the openings 40, 42, 44. In example embodiments, the rebar bundles are connected to the rebar cage 68, as for example by being welded or tied to the rebar cage. Concrete (or other retaining media) is the poured over the base to fill the excavation site and encapsulate the rebar cage. In an example embodiment, concrete is also poured into the bollard. A cap 72 may be used to cap the upper end of the bollard after it is filled with concrete.

In example embodiments, multiple shallow foundation bollard structures may be installed spaced apart from each other with rebar or rebar bundles 70 penetrating all such bollard structures. In an example embodiment, a single cage may be formed surrounding all bollard structures. Example embodiment shallow foundation bollards may be installed at excavated pits less than three feet in depth from grade. In other example embodiments, the excavated pits may be up to two feet in depth from grade. In a further example embodiment, the excavated pits are about two feet in depth from grade.

In an example embodiment, upon impact, the base with the bollard will rotate such that the base impacts the undercarriage of the impacting vehicle, further aiding the stopping of the vehicle. The example embodiment foundation bollards described herein have been able to stop a 15,000 truck having a velocity of 52 MPH impacting the bollard structure along direction 54 as shown in FIG. 3 and meet the 2020 ASTM M50 Standard P2 Dynamic and P1 Static requirements as well as the 2020 ASTM M30 P1 requirements. Similar results are expected if the impact direction is opposite of the direction 54 shown in FIG. 3.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. For example, the upper and lower walls of the base may be formed by plates instead of channel members and the two side walls may formed by channel members instead of plates. In other example embodiments, the upper, lower and side walls may be formed from plates that are welded or otherwise interconnected together. In one example embodiment, corner members may be used to connect or weld such adjacent plates.

Although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "generally," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is referred to as being "coupled" to another component, it can be directly attached to the other component or intervening components may be present therebetween.

The invention claimed is:

1. A bollard structure comprising:

a base comprising, an upper wall, a lower wall, a first side wall extending between the upper and lower walls, a second side wall extending between the upper and lower walls and spaced apart from the first side wall, and a mid-wall extending between the upper and lower walls and between the first and second sidewalls; and a bollard penetrating the upper wall and extending to the lower wall between the two sidewalls, wherein said mid-wall extends from said bollard, wherein the mid-wall is a web of an I-beam, wherein the I-beam extends from the upper wall to the lower wall.

2. The structure of claim 1, further comprising at least one upper reinforcing plate above the upper wall penetrated by said bollard.

3. The structure of claim 1, further comprising at least one lower reinforcing plate penetrated by said bollard.

4. The structure of claim 1, wherein said mid-wall is a first mid-wall, and the structure further comprises a second mid-wall extending from the bollard opposite from said first mid-wall.

5. The structure of claim 4, wherein the second mid-wall is welded to the bollard.

6. The structure of claim 4, wherein the second mid-wall is a web of a second I-beam, wherein the second I-beam extends from the upper wall to the lower wall.

7. The structure of claim 1, wherein the upper wall is a web of an upper channel, said upper channel comprising a first wall and second wall extending transversely from said web, wherein the first side wall is connected to the upper channel first wall and the second side wall is connected to the upper channel second wall.

8. The structure of claim 4, wherein the lower wall is a web of a lower channel, said lower channel comprising a first wall and second wall extending transversely from said lower channel web, wherein the first side wall is connected to the lower channel first wall and the second side wall is connected to the lower channel second wall.

9. The structure of claim 1, wherein the bollard is tubular, the structure further comprising a stiffener extending within the bollard.

10. The structure of claim 9, wherein the stiffener extends from a base of the bollard along at least 80% of a length of the bollard.

11. The structure of claim 9, wherein the stiffener is a box beam.

12. The structure of claim 9, wherein the stiffener is a plate.

13. The structure of claim 9, wherein the stiffener is connected to opposite inner surfaces of the bollard.

14. The structure of claim 1, wherein the first side wall comprises first openings formed therethrough.

15. The structure of claim 14, wherein the second side wall comprises second openings formed therethrough.

16. The structure of claim 15, wherein the first and/or second openings are sized to receive a fork of a fork lift for allowing for lifting and movement of said structure by a fork lift.

17. The structure of claim 15, wherein the first and/or second openings are sized to allow for welding and inspection of an interior of said structure.

18. The structure of claim 17, wherein the first and second openings are configured for receiving rebar bundles therethrough.

19. The structure of claim 18, wherein the mid-wall comprises openings axially aligned with the first and second openings for receiving rebar bundles therethrough.

20. The structure of claim 1, further comprising a rebar cage surrounding said base.

21. The structure of claim 20, wherein the rebar cage comprises:

a lower rebar grid;

an upper rebar grid, wherein the base is sandwiched between the lower and upper rebar grids;

a plurality of spaced apart truncated cone shaped rebar members extending from the upper wall to the lower rebar grid; and a plurality of hook shaped rebar members, wherein each hook shaped rebar member of said plurality of hook shaped rebar members comprises a hook portion hooked on the upper rebar grid and extending to the lower rebar grid.

22. The structure of claim 21, wherein the plurality of hook shaped rebar members are connected to upper and lower rebar grids and wherein the plurality of truncated cone shaped rebar members are connected to the lower grid.

23. A bollard structure comprising:

a base comprising, an upper wall, a lower wall, a first side wall extending between the upper and lower walls, a second side wall extending between the upper and lower walls and spaced apart from the first side wall, and a mid-wall extending between the upper and lower walls and between the first and second sidewalls; and a bollard penetrating the upper wall and extending to the lower wall between the two sidewalls, wherein said mid-wall extends from said bollard, wherein said mid-wall is a first mid-wall, and the structure further comprises a second mid-wall extending from the bollard opposite from said first mid-wall, and wherein the second mid-wall is a web of an I-beam, wherein the I-beam extends from the upper wall to the lower wall.

24. A bollard structure comprising:

a base comprising, an upper wall, a lower wall, a first side wall extending between the upper and lower walls, a second side wall extending between the upper and lower walls and spaced apart from the first side wall, and a mid-wall extending between the upper and lower walls and between the first and second sidewalls;

a bollard penetrating the upper wall and extending to the lower wall between the two sidewalls, wherein said mid-wall extends from said bollard; and at least one upper reinforcing plate above the upper wall penetrated by said bollard.

25. The structure of claim 24, further comprising at least one lower reinforcing plate penetrated by said bollard.

26. A bollard structure comprising:

a base comprising, an upper wall, a lower wall, a first side wall extending between the upper and lower walls, a second side wall extending between the upper and lower walls and spaced apart from the first side wall, and a mid-wall extending between the upper and lower walls and between the first and second sidewalls;

a bollard penetrating the upper wall and extending to the lower wall between the two sidewalls, wherein said mid-wall extends from said bollard, and at least one lower reinforcing plate penetrated by said bollard.

* * * * *